US006670747B2

(12) United States Patent
Ito et al.

(10) Patent No.: US 6,670,747 B2
(45) Date of Patent: Dec. 30, 2003

(54) ELECTRON SOURCE DEVICE, METHOD OF MANUFACTURING THE SAME, AND FLAT DISPLAY APPARATUS COMPRISING AN ELECTRON SOURCE DEVICE

(75) Inventors: Takeo Ito, Kumagaya (JP); Sadao Miki, Kyoto (JP); Kazuo Sakai, Kawanishi (JP)

(73) Assignees: Kabushiki Kaisha Toshiba, Tokyo (JP); Fuji Pigment Co., Ltd., Kawanishi (JP)

( * ) Notice: Subject to any disclaimer, the term of this patent is extended or adjusted under 35 U.S.C. 154(b) by 0 days.

(21) Appl. No.: 09/990,267

(22) Filed: Nov. 23, 2001

(65) Prior Publication Data

US 2002/0030438 A1 Mar. 14, 2002

Related U.S. Application Data

(63) Continuation of application No. PCT/JP01/02368, filed on Mar. 23, 2001.

(30) Foreign Application Priority Data

Mar. 24, 2000 (JP) ..... 2000-085257

(51) Int. Cl.[7] ..... H01J 1/304; H01J 1/02

(52) U.S. Cl. ..... 313/497; 313/495; 313/496; 313/309

(58) Field of Search ..... 313/309, 310, 313/311, 495, 496, 497, 306; 445/24, 50; 438/20

(56) References Cited

U.S. PATENT DOCUMENTS 5,164,632 A * 11/1992 Yoshida et al. ..... 313/309
5,315,206 A * 5/1994 Yoshida ..... 313/306
5,653,619 A * 8/1997 Cloud et al. ..... 445/24
5,702,281 A * 12/1997 Huang et al. ..... 257/10
6,034,468 A 3/2000 Wilshaw
6,356,014 B2 * 3/2002 Xu et al. ..... 313/309
6,472,814 B1 * 10/2002 Yamanobe et al. ..... 313/495
2002/0117960 A1 * 8/2002 Yi et al. ..... 313/495

FOREIGN PATENT DOCUMENTS

| | | |
|---|---|---|
| JP | 2923980 | 2/1991 |
| JP | 3007654 | 2/1992 |
| JP | 4-264337 | 9/1992 |
| JP | 5-211030 | 8/1993 |
| JP | 7-220619 | 8/1995 |
| JP | 3008852 | 1/1998 |
| JP | 2000-34162 | 2/2000 |

* cited by examiner

*Primary Examiner*—Vip Patel
*Assistant Examiner*—Karabi Guharay
(74) *Attorney, Agent, or Firm*—Oblon, Spivak, McClelland, Maier & Neustadt, P.C.

(57) ABSTRACT

Phosphor layers are formed on the inner surface of a face plate. An electron source device that emits electrons to excite the phosphor layers is provided on the inner surface of a base plate. The electron source device comprises an alumina substrate that has a number of small through holes. Electron-emitting material is buried in the through holes. A reference electrode is formed on the lower surface of the alumina substrate and contacts the electron-emitting material. A gate electrode is formed on the upper surface of the substrate and insulated from the electron-emitting material. The gate electrode is configured to concentrate an electron field of the electron-emitting material by virtue of an voltage applied between the reference electrode and the gate electrode, thereby to cause the electron-emitting material to emit electrons toward the phosphor layers.

3 Claims, 2 Drawing Sheets

ELECTRON SOURCE DEVICE, METHOD OF MANUFACTURING THE SAME, AND FLAT DISPLAY APPARATUS COMPRISING AN ELECTRON SOURCE DEVICE

CROSS-REFERENCE TO RELATED APPLICATIONS

This is a Continuation Application of PCT application No. PCT/JP01/02368, filed Mar. 23, 2001, which was not published under PCT Article 21(2) in English.

This application is based upon and claims the benefit of priority from the prior Japanese Patent Application No. 2000-085257, filed Mar. 24, 2000, the entire contents of which are incorporated herein by reference.

BACKGROUND OF THE INVENTION

The present invention relates to an electron source device for use in field-emission displays (hereinafter referred to as "FEDs") or the like, a method of manufacturing the same, and a flat display apparatus comprising the electron source device.

In recent years, FEDs have been developed for use as flat displays. An FED has a face plate and a rear plate that are arranged, opposing each other and spaced apart by a predetermined distance. The plates are jointed at their peripheral edges by a side wall shaped like a rectangular frame, thus forming a vacuum envelope. Phosphor layers of three colors are formed on the inner surface of the face plate. An electron-emitting source for exciting the phosphors is provided on the inner surface of the rear plate.

Hitherto, a structure called "spindle type" has been proposed as an electron-emitting source for use in FEDs. This electron-emitting source is configured to concentrate an electric field at the sharp tip of an electron-emitting section made of Mo and emit electrons from the electron-emitting section by virtue of the voltage applied between it and the phosphor layers, thereby causing the phosphor layers to emit light. Thus, a thin flat display apparatus is provided.

The electron-emitting source has a very fine structure, however. It is very difficult to form many electron-emitting sources in uniformity and in a simple method. It is therefore hard to manufacture large flat display apparatuses by using the electron-emitting sources. The manufacturing cost of even a flat display apparatus with a small screen will be inevitably high. Moreover, the apparatus can hardly display stable images, because the electron-emitting sources differ in electron-emitting ability even if the sources differ in shape only a little.

BRIEF SUMMARY OF THE INVENTION

The present invention has been made to solve the problem described above, and its object is to provide an electron source device which is uniform, large and inexpensive and which has a high electron-emitting ability, a method of manufacturing the device, and a flat display apparatus comprising the electron source device.

To achieve the object described above, an electron source device according to an aspect of the invention comprises; an oxide substrate having a number of small through holes; electron-emitting material buried in the through holes; a first electrode formed on one surface of the oxide substrate and contacting the electron-emitting material; and a second electrode provided on another surface of the oxide substrate, insulated from the electron-emitting material and configured to generate a concentration of an electric field of the electron-emitting material by virtue of an voltage applied between the first electrode and the second electrode, thereby to cause the electron-emitting material to emit electrons.

In the electron source device according to another aspect of the invention, the oxide substrate may be made of alumina and the electron-emitting material may preferably be a carbon-based material.

In the electron source device according to another aspect of the invention, the through holes may have a diameter of 500 $\mu$m to 0.1 nm, preferably 10 $\mu$m to 1 nm and the oxide substrate may have a thickness of 0.1 $\mu$m to 10 mm.

A method of manufacturing an electron source device, according to an aspect of the invention, comprises: subjecting a metal substrate to electric-field oxidation, thereby forming an oxide substrate having a number of small through holes; burying an electron-emitting material in the through holes of the oxide substrate; forming a first electrode on one surface of the oxide substrate so as to contact the electron-emitting material; and forming a second electrode on another surface of the oxide substrate, the second electrode insulated from the electron-emitting material.

In the method of manufacturing an electron source device, according to another aspect of the invention, an electrolysis voltage may be controlled in the electrolytic oxidation so as to control the diameter of the small through holes, and an electrolysis time may be controlled in the electrolytic oxidation so as to control the diameter of the small through holes.

A flat display apparatus according to another aspect of the present invention comprises: a first substrate and a second substrate arranged, opposing to each other; phosphor layers provided on an inner surface of the first substrate; and an electron source device provided on an inner surface of the second substrate and configured to excite the phosphor layers. The electron source device comprises an oxide substrate having a number of small through holes and provided on an inner surface of the second substrate, electron-emitting material buried in the through holes, a first electrode formed on that surface of the oxide substrate, which faces the second substrate, and contacting the electron-emitting material, and a second electrode provided on other surface of the oxide substrate, insulated from the electron-emitting material and configured to generate an electron field concentration of the electron-emitting material by virtue of an voltage applied between the first electrode and the second electrode, thereby to cause the electron-emitting material to emit electrons toward the phosphor layers.

As has been described above, an oxide substrate having numerous small through holes is used in the present invention. A mass of electron-emitting material is provided in one end of each through hole, and an electrode is formed at the other side of the oxide substrate. A voltage is applied between the mass and the electrode. Hence, the invention can provide an electron source device that is uniform, has high electron-emitting ability and is inexpensive. It can provide a method of manufacturing the device and a flat display apparatus comprising the device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

There will now be described in detail an embodiment wherein a flat display apparatus according to the invention is applied to a field-emission display (hereinafter referred to as "FED"), with reference to the drawings.

Figure 1:
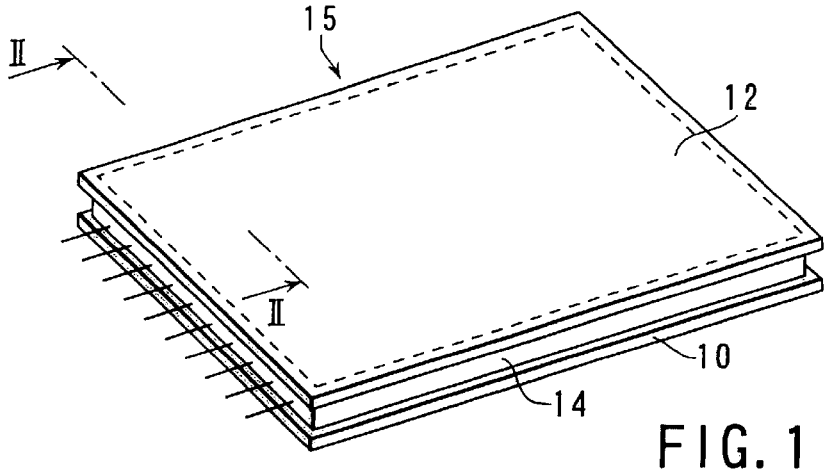
FIG. 1 is a perspective view showing an electron-emitting apparatus of surface conduction electron emitter type.
Figure 2:
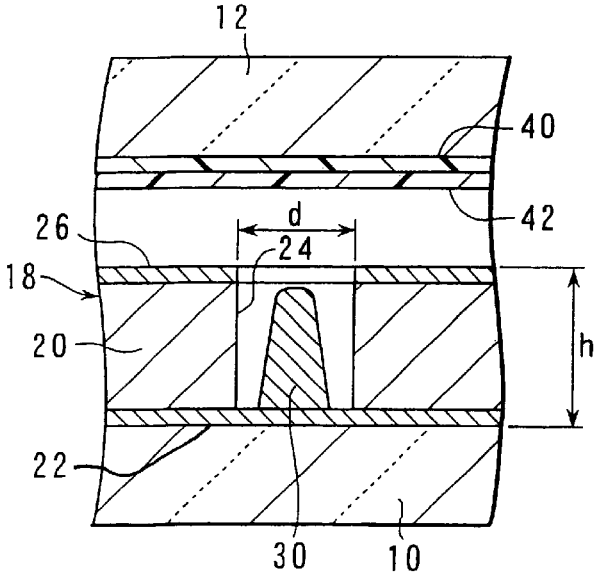
FIG. 2 is a sectional view taken along line II—II in FIG. 1.

As shown in FIGS. 1 and 2, the FED comprises a rear plate 10 and a face plate 12, both being rectangular glass plates. These plates are arranged, opposing each other and spaced apart by a predetermined distance. The rear plate 10 and the face plate 12 are jointed together at their edges by a frame-shaped side wall 14 that is made of glass, thus forming a flat, rectangular vacuum envelope 15.

A phosphor screen 42 is formed on the inner surface of the face plate 12. The phosphor screen 42 comprises red, blue and green phosphor layers and black layers, which are arranged on the inner surface of the face plate 12. The phosphor layers are shaped like stripes or dots. Between the phosphor screen 42 and the face plate 12 there is formed an opposing electrode 40 made of, for example, ITO.

An electron source device 18 is provided on the inner surface of the rear plate 10. The device 18, which will be described later, is configured to emit an electron beam, which excites the phosphor layers. The side wall 14 is sealed to the edges of the rear plate 10 and face plate 12 with flit glass that is low-melting glass or with low-melting metal such as indium or the like. The face plate and the rear plate are thereby jointed to each other. Between the rear plate 10 and the face plate 12, a number of spacers (not shown) are arranged at prescribed intervals, keeping the plates spaced apart. The spacers are shaped like plates or columns.

As FIG. 2 shows, the electron source device 18 has an alumina substrate 20. The alumina substrate 20 is provided on the inner surface of the rear plate 10, opposes the phosphor screen 42 and is spaced therefrom by a prescribed distance. The alumina substrate 20 has many small through holes 24 that extend almost perpendicular to the surface of the substrate. A reference electrode 22 is formed on the lower surface of the alumina substrate 20, i.e., the surface that opposes the rear plate 10. The electrode 22, which is formed of a conductive thin film and serves as the first electrode, closes the lower openings of the through holes 24.

Electron-emitting material 30, which are almost conical, each decreasing in diameter toward the phosphor screen 42, are buried in some of the through holes 24 and contact the reference electrode 22. The distal end of each electron-emitting material 30 lies as high as the upper opening of the through hole 24. A gate electrode 26 made of a thin conductive film is formed, as the second electrode, on the upper surface of the alumina substrate 20, which opposes the phosphor screen 42. The gate electrode 26 has holes, which are continuous to the upper openings of the through holes 24. The gate electrode 26 is insulated from the electron-emitting material 30.

In the electron source device 18, a voltage (V1) is applied to the gate electrode 26 with respect to the reference electrode 22, generating an electric field concentraction at the distal end of each electron-emitting material 30. Electrons are thereby emitted from the electron-emitting material 30. The electrons thus emitted are impinged onto the phosphor layers, by virtue of the voltage (V2) applied to the opposing electrode 40 provided at the phosphor screen 42. The phosphor layers therefore emit light. The electron-emitting material 30 are arranged in rows and columns and thus aligned with pixels. Therefore, the materials 30 serve to display desired images.

In the electron source device 18, it is desired that the through holes 24 have as small a diameter d as possible. The smaller the diameter d, the greater the concentration of the electric field. The diameter d is set to 500 $\mu$m to 0.1 nm, preferably 10 $\mu$m to 1 nm. If the diameter d is too large, the electric field is not sufficiently concentrated and a higher voltage must be applied to generate electrons. If the diameter d is too small, it is difficult to make such small through holes.

The distal ends of the electron-emitting materials 30 need not lie at the same height as the gate electrode 26. Even if the electron-emitting materials 30 are provided at a lower level, for example at the bottom of the through holes 24, they can emit electrons in sufficient numbers, though the minimum electron-inducing voltage. The shorter the distance between each electron-emitting material 30 and the gate electrode 26, the more readily the electric field will be concentrated. If the materials 30 lie too close to the gate electrode 26, however, discharge will likely occur. The distance is set to an appropriate value, in consideration of a possible easiness of forming the materials 30, the design voltage and the desired electron-emitting ability.

The depth h of the though holes, i.e., the thickness of the alumina substrate 20, is set to 0.1 $\mu$m to 10 mm, more preferably 1.0 $\mu$m to 1.0 mm. If the alumina substrate 20 is too thin, it may be broken unless it is carefully treated. If the substrate 20 is too thick, it will take much time to make the through holes 24.

The reference electrode 22 and the gate electrode 26 can be a film of Au, Ag, Al, Cu, Ni, ITO or the like.

The electron-emitting materials 30 can be made of any material such as carbon-based material, metal-based material or silicon-based material. The carbon-based material may be carbon compounds prepared by modifying various organic substances or may be carbon nano-tube, diamond-like carbon or the like. The metal-based material may be a known electron-source material, a representative example of which is Mo.

Figure 3:
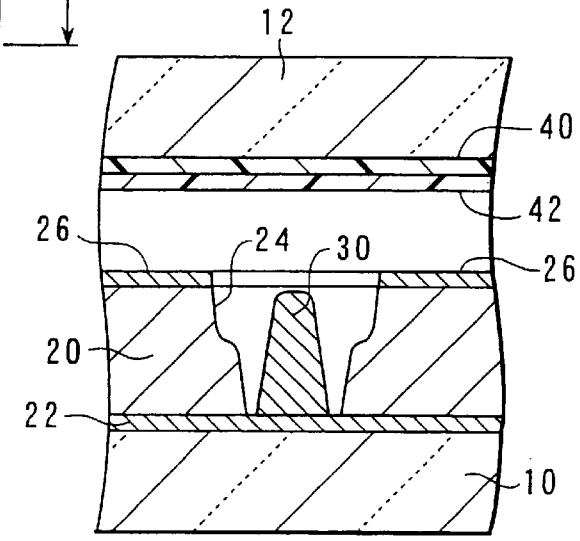
FIG. 3 is a sectional view illustrating a modification of the electron source device incorporated in the electron-emitting apparatus.

As shown in FIG. 3, the through holes 24 made in the alumina substrate 20 may have a larger diameter in the upper part located on the gate electrode side than the lower part located on the reference electrode side. Namely, each through hole 24 may have a two-stepped configuration to have an increased withstand voltage.

Figure 4:
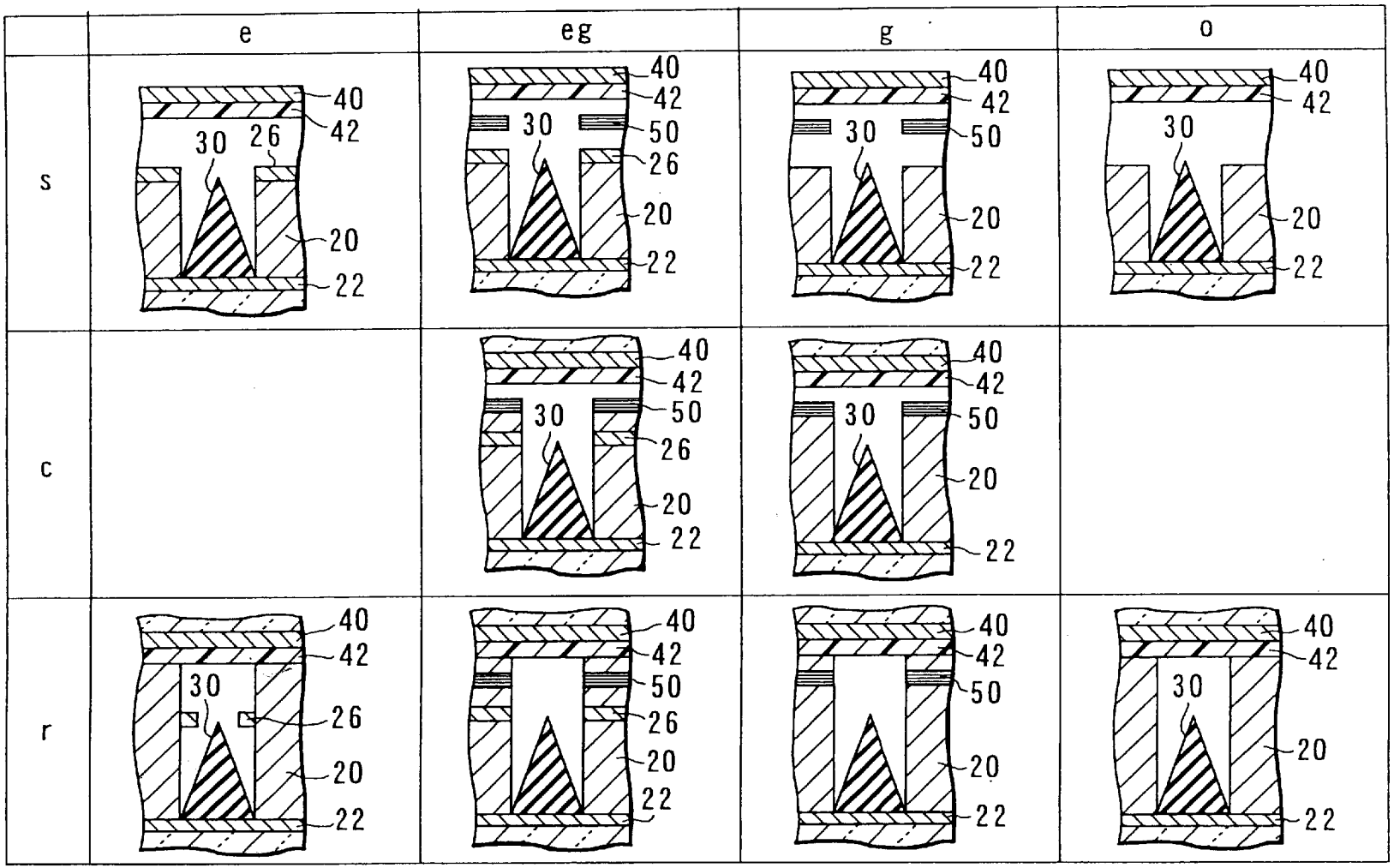
FIG. 4 is a diagram showing various configurations of the electron source device.

The electron source device 18 may have various structures shown in FIG. 4, other than the fundamental structure illustrated in FIG. 2. In terms of types and number of electrodes, the structures can be classified into several types. Type e has a reference electrode 22 and a gate electrode 26. Type eg comprises a reference electrode 22, a gate electrode 26 and a focusing electrode 50, i.e., the third electrode. Type g comprises a reference electrode 22 and a focusing electrode 50, not having a gate electrode 26. Type o has a reference electrode 22 only. In the case of the Type g, the focusing electrode 50 functions as the second electrode. In the case of the Type 0, the opposing electrode 40 serves as the second electrode.

In terms of the positional relation between the holes 24 and the electrodes, the structures can be classified into several Types. In Type S, the phosphor screen 42 is spaced apart from the alumina substrate 20. In Type C, the focusing electrode 50 is formed integral with the alumina substrate 20. In Type r, the alumina substrate 20 contacts the phosphor screen 42. In the Type S, the focusing electrode 50 is spaced from that surface of the alumina substrate 20 which opposes the phosphor screen 42. These Types may be combined in different ways, thus providing electron source devices of various structures illustrated in FIG. 4. Moreover, through holes of such a two-stepped configuration as shown in FIG. 3 may be used. The various electron source devices are identical in any other structural aspects. The identical components of the devices will not be described in detail.

A method of manufacturing the electron source device 18 thus structured will be explained. First, an aluminum plate is immersed in a bath of phosphoric acid or sulfuric acid and is thereby subjected to electrolytic oxidation. The plate is thereby changed to an alumina substrate 20 that has many through holes 24 extending perpendicular to the surfaces. The diameter d of the through holes 24 depends on the electrolysis voltage. The higher the electrolysis voltage, the greater the diameter d. For example, the diameter d is 10 nm when the electrolysis voltage is 6V, and is 300 nm when the electrolysis voltage is 150V. Thus, the diameter d is proportional to the electrolysis voltage. The depth h of the through holes depends on the electrolysis time. For example, the depth h is 1 $\mu$m when the electrolysis time is 5 minutes, and is 10 $\mu$m when the electrolysis time is 50 minutes. The depth h is almost proportional to the electrolysis time.

The through hole 24 shown in FIG. 3, which has a two-stepped configuration, can be easily made. First, small holes are made in the substrate 20 by the method described above. Then, the small holes are filled with electron-emitting material. Then, a lower electrolysis voltage is applied, performing electrolytic oxidation on the alumina substrate 20.

Next, a metal foil for forming an electrode is adhered to the lower surface of the alumina substrate 20 thus prepared. The reference electrode 22 is thereby formed. Gold or the like is vapor-deposited on the upper surface of the alumina substrate 20, thereby forming the gate electrode 26.

The through holes 24 are filled with the electron-emitting material, by any one of the following methods. In the first method, the through holes 24 are filled with organic substance. The organic substance is baked and carbonized and changed to electron-emitting material 30. When baked, the organic substance shrinks, forming materials of an almost desired structure.

Two methods of using the organic substance are available. One method is to use novolac resin, aclyric resin, cellulose, polyimide, oligomer such as carbon pitch, or polymer. The other method is to fill the through holes with, for example, an polymerizable material such as ethylene derivative, styrene derivative, acrylonitrile or cyanoacrylic acid, and to polymerize the polymerizable material in the through holes.

In the latter method, the material more shrinks, effectively increasing the withstand voltage. Any organic substance used should be easily carbonized. In order to enhance the mold release property after the baking and carbonization and increase the insulation from the gate electrode, the alumina substrate may be treated. It is useful to coat the substrate with a mold release agent such as silane coupling agent or fluorine-based surfactant.

The second method is to insert the carbon material itself into the through holes 24. That is, the carbon material, such as graphite, electrically conductive carbon, pitch, tar or carbon nano-tube, is sealed in the through holes by using a particulate fluid dispersion technique.

The third method is to apply to the surface of each through hole 24 from the lower surface of the alumina substrate 20 by means of CVD or vapor deposition, before the reference electrode is formed. If a metal material such as Mo is used, vapor deposition is employed. If this method is performed, the structure of FIG. 2 will be obtained. If the metal material is used, an electrolysis process may be carried out. In this case, the through holes 24 are filled up with the metal material and a voltage is applied between the material and the reference electrode, thus electrolyzing the material. The aluminum at the gate electrode is thereby decomposed, providing a gap between the metal material and the circumferential surface of each through hole. This method can shorten the distance between the metal material and the circumferential surface of each through hole, whereby the electron-emitting voltage is made low.

To display color images, it is necessary to form a pattern of electron sources that correspond to the red, blue green pixels. The pattern can be formed by sealing all substrate with insulating material, after making the through holes, except those parts on which electron sources will be provided.

(Embodiment 1)

Anodic oxidation was carried out in 4%-aquous solution of phosphoric acid, using an anode that is an aluminum foil having a thickness of 40 $\mu$m and a diagonal size of 30 inches. The anodic oxidation was performed for 240 minutes at a voltage of 50V, making in many through holes having a diameter of 120 nm. Then, the aluminum foil was adhered to a glass substrate, by using silver paste as adhesive. The silver paste served as reference electrode. Thereafter, the through holes were filled with novolac resin. The resultant structure was first baked in the air at 300° C. and then in an Ar atmosphere at 500° C., thus promoting carbonization. At that time, the novolac resin was completely carbonized and reduced in volume. A novolac resin layer was formed, which lay in conductive contact with the silver paste at the bottom and was spaced from the upper rim of each through hole.

Next, Au was vapor-deposited on the aluminum film, applying the vapor from the above at an angle of about 30°. A gate electrode was thereby formed. A phosphor screen was arranged at a distance of 1 mm from the gate electrode. In the electron source device thus manufactured, an emission current began to flow when the voltage applied on the gate electrode exceeded 60V, causing the phosphor layers to emit light. Hence, a large flat display apparatus could be manufactured at a low cost.

(Embodiment 2)

The anodic oxidation was performed in two steps, in Embodiment 1. In the first step, a voltage of 50V was applied, forming narrow holes having a diameter of 150 nm. In the second step, a voltage of 150V was applied for half the voltage-applying period in the first step. As a result, through holes having a two-stepped configuration were made. The upper half of each through hole had a diameter of 300 nm, and the lower half thereof had a diameter of 150 nm.

The through holes were filled with novolac resin. The resultant structure was carbonized in the same way as in Embodiment 1. Then, the structure was adhered to a glass substrate, by using silver paste as adhesive. The device thus manufactured was tested for its emission characteristic. The device exhibited the same emission characteristic as that of Embodiment 1. Further, it exhibited a better withstand voltage characteristic.

(Embodiment 3)

Through holes were made in an aluminum foil in the same way as in Embodiment 1. Thereafter, novolac resin was applied into the holes, from the lower surface of the foil. The resultant structure was subjected to carbonization. Only lower half of each through hole was filled with the novolac resin. The aluminum foil was adhered to a glass substrate, by using silver paste. A phosphor screen was placed above the resultant structure to determine the emission characteristic of the structure. The emission-starting voltage was 70V that is lower than that of Embodiment 1. Nonetheless, the second embodiment could be manufactured in a simpler method and, hence, at a lower cost.

(Embodiment 4)

This embodiment is identical to Embodiment 1, except that novolac resin was replaced by hydroxylcellulose, thereby manufacturing an electron source apparatus. The emission characteristic was determined. The apparatus exhibited a lower emission-starting voltage of 45V.

(Embodiment 5)

Embodiment 5 is embodiment is identical to Embodiment 1, except that the aluminum foil was treated with octadodecyltrichlorosilane before novolac resin was applied. It was confirmed that the withstand voltage characteristic increased.

(Embodiment 6)

Embodiment 6 is identical to Embodiment 1, except that a suspension containing graphite fine particles was used in place of novolac resin. The through holes were filled with the suspension. In this case, carbonization was not absolutely necessary. When the binder was only removed, an electron-emitting material was obtained. Since it was possible to perform carbonization beforehand, the electron-generating characteristic obtained was less prominent.

(Embodiment 7)

This embodiment is identical to Embodiment 1, except Mo was vapor-deposited on the aluminum film, applying the vapor slantwise from the above. An Mo film was thereby formed in the lower part of each through hole. The electron-generating characteristic was determined to be similar to the one described above.

As indicated above, in the electron source device and the method of manufacturing the same, both according to this embodiment, a number of small through holes are formed quite easily in conditions precisely controlled. The electron source device can therefore be large and excel in uniformity. Additionally, various electron-emitting materials can be used. An optimal material can be selected in accordance with the purpose. Further, through holes of various sizes can be easily made, from large ones having diameters in the order of microns to small ones in the order of nanometers. Particularly, an electron source device having a size in the order of nonameters can be produced, which has been hitherto difficult to achieve. Thousands or more of unit electron sources can therefore correspond to a single pixel. Not the efficiency, but also the reliability can be enhanced. Hence, it is possible to provide a large, inexpensive FED.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the materials used are not limited to those utilized in the embodiments described above. If necessary, other various materials can be selected and used. The invention is not limited to an FED. It can be applied to other types of flat displays.

What is claimed is:

1. A flat display apparatus comprising:

a first substrate and a second substrate arranged, opposing to each other;

phosphor layers provided on an inner surface of the first substrate; and an electron source device provided between the first and second substrates, configured to excite the phosphor layers, and comprising an oxide substrate having a first surface opposing the second substrate, a second surface contacting the phosphor layers, and a number of small through holes including a first opening open to the first surface and a second opening open to the second surface, a single kind of electron-emitting material buried in the through holes from the first openings to regions closed to the second openings, a first electrode formed on the first surface of the oxide substrate, which faces the second substrate, and contacting the electron-emitting material, and a second electrode provided on the second surface side of the oxide substrate, insulated from the electron-emitting material and configured to concentrate an electron field of the electron-emitting material by virtue of an voltage applied between the first electrode and the second electrode so as to cause the electron-emitting material to emit electrons toward the phosphor layers.

2. The flat display apparatus according to claim 1, wherein the through holes have a diameter of 500 $\mu$m to 0.1 nm, and the oxide substrate has a thickness of 0.1 $\mu$m to 10 mm.

3. The flat display apparatus according to claim 1, which comprises a third electrode sandwiching the second electrode, jointly with the first electrode, and configured to converge the electrons emitted.

* * * * *